US005949387A

United States Patent [19]

Wu et al.

[11] Patent Number: 5,949,387

[45] Date of Patent: Sep. 7, 1999

[54] FREQUENCY SELECTIVE SURFACE (FSS) FILTER FOR AN ANTENNA

[75] Inventors: Te-Kao Wu, Rancho Palos Verdes; John J. Macek, Torrance; Mark E. Bever, Redondo Beach, all of Calif.

[73] Assignee: TRW Inc., Redondo Beach, Calif.

[21] Appl. No.: 08/841,185

[22] Filed: Apr. 29, 1997

[51] Int. Cl.[6] ..... H01Q 15/23; H01Q 15/14; H01Q 15/02

[52] U.S. Cl. ..... 343/909; 343/754; 343/753; 343/781; 343/907

[58] Field of Search ..... 343/909, 754, 343/753, 781, 893, 912, 841, 725, 705, 708, 910; 333/134, 202; H01Q 15/23, 15/14, 15/02

[56] References Cited

U.S. PATENT DOCUMENTS

| | | |
|---|---|---|
| 4,439,768 | 3/1984 | Ebneth et al. . |
| 4,656,487 | 4/1987 | Sureau et al. . |
| 4,814,785 | 3/1989 | Wu . |
| 5,103,241 | 4/1992 | Wu . |
| 5,130,718 | 7/1992 | Wu et al. . |
| 5,140,338 | 8/1992 | Schmier et al. . |
| 5,160,936 | 11/1992 | Braun et al. . |
| 5,162,809 | 11/1992 | Wu . |
| 5,208,603 | 5/1993 | Yee . |
| 5,276,455 | 1/1994 | Fitzsimmons et al. . |
| 5,373,302 | 12/1994 | Wu . |
| 5,384,575 | 1/1995 | Wu . |
| 5,471,224 | 11/1995 | Barkeshli . |
| 5,497,169 | 3/1996 | Wu . |
| 5,543,815 | 8/1996 | Wu et al. . |

FOREIGN PATENT DOCUMENTS

| | | |
|---|---|---|
| 0096529 | 12/1984 | European Pat. Off. . |
| 8401242 | 3/1984 | WIPO . |

*Primary Examiner*—Robert H. Kim
*Assistant Examiner*—Layla G. Lauchman
*Attorney, Agent, or Firm*—Michael S. Yatsko

[57] ABSTRACT

A frequency selective surface filter (20 or 50) particularly useful in connection with a transmit antenna (10) for passing and rejecting signals in multiple frequency bands. According to one embodiment, the frequency selective surface filter (20) has a single conductive screen (24) disposed on a dielectric medium (22). The single-conductive screen (24) includes an array of parallel intersecting lines (26) and (28) providing low frequency filtering. The single-conductive screen (24) also includes an array of double-loop conductive elements each made up of an inner conductive loop (32) and an outer conductive loop (30). According to a second embodiment, the frequency selective surface filter (50) contains two dielectrically separated conductive layers including a first conductive layer (52) having an array of double-slots made up of an inner slot (64) and an outer slot (66). The double-slot configuration further includes a second conductive layer (60) made up of an array of single conductive loops (62).

18 Claims, 5 Drawing Sheets

FREQUENCY SELECTIVE SURFACE (FSS) FILTER FOR AN ANTENNA

BACKGROUND OF THE INVENTION

1. Technical Field

This invention relates generally to a frequency selective surface (FSS) and, more particularly, to a frequency selective surface filter for passing and rejecting signals in multiple selected frequency bands and for use in connection with an antenna.

2. Discussion

Frequency selective surfaces have been used in connection with wireless transmission systems such as antenna systems to reject the transmission of signals in a selected frequency band, while allowing signals in a selected frequency band to pass through the frequency selective surface. Accordingly, the frequency selective surface can advantageously be used to filter out signals at a certain frequency. Frequency selective surfaces are especially useful for satellite antenna systems where multiple signals at different frequencies may be present and only selected frequency signals are to be transmitted to or from a given antenna system device.

Known frequency selective surfaces have generally consisted of an array of conductive elements fabricated on a dielectric medium. The dielectric medium is generally transparent to signal radiation, while the conductive elements are configured to selectively allow signals of certain frequencies to pass therethrough and reject signals at other frequencies. Typically, the conductive elements are often configured as closed loops, usually configured as square loops or circular loops. Generally speaking, the dimensions of the conductive elements determine the passband and rejection band of the frequency selective surface. The use of an array of conventional single conductive loops of identical size and shape will provide a single narrow band of rejection. However, the single loop configuration provides only limited signal rejection in a rather narrow frequency rejection band.

More recently, a double-loop frequency selective surface has been used in connection with a dual reflector antenna. One example of such a double-loop frequency selective surface is described in U.S. Pat. No. 5,373,302, entitled "Double-Loop Frequency Selective Surfaces For Multi Frequency Division Multiplexing in a Dual Reflector Antenna", issued to Wu on Dec. 13, 1994. The aforementioned issued U.S. patent is incorporated herein by reference. The double-loop frequency selective surface configuration provides an array of two different size conductive loop elements on a sub-reflector which reflect signals at two different frequency bands back into a main reflector. While dual frequency reflection bands are obtainable, each of the reflection bands effectively reflects signals over a narrow range of frequencies.

In more recent times, it has become desirable to provide signal filtering for antenna operations. The multibeam phased array antenna has been developed especially for use on a satellite system which can be operable at various operating frequencies. For example, in a multiband communication system, a transmit antenna may be operable to transmit signals at frequencies in the K-band such as 20.2 to 21.2 GHz, while a receive antenna may be operable to receive signals at frequencies in the Q-band such as 41 GHz. Further, crosslink communication among satellites may operate at frequencies in the V-band such as 62.6 GHz. One problem that may arise with the transmit antenna is that the antenna's transmit circuitry generally employs power amplifiers which exhibit non-linear characteristics. These non-linear power amplifiers as well as other non-linear circuitry which are commonly provided in active antennas may produce high frequency second and third harmonics. The high frequency second and third harmonics generated by the transmit antenna can interfere with the receive and crosslink channels, unless adequate signal filtering is provided. Such a filtering device for spaceborne satellite systems and the like is generally required to be small and as lightweight as possible.

It is therefore desirable to provide for a frequency selective surface that provides both signal passing in a specified frequency band and signal rejection in multiple frequency rejection bands. It is also desirable to provide for such a frequency selective surface that realizes wide bandwidth frequency rejection. It is further desirable to provide for a frequency selective surface for use with an active antenna. It is particularly desirable to provide such a frequency selective surface filter for filtering out unwanted signals caused by the amplifier's high frequency harmonics, especially with a transmit antenna. Yet, it is further desirable to provide a frequency selective surface with multiple frequency rejection bands in a compact, low cost and lightweight package suitable for use on a spaceborne or ground antenna system.

SUMMARY OF THE INVENTION

In accordance with the teachings of the present invention, a frequency selective surface filter is provided for passing and rejecting multiple frequency bands. According to one embodiment, the frequency selective surface filter has a single conductive screen disposed on a dielectric substrate. The single conductive screen includes a square grid having a first plurality of parallel conductive lines perpendicularly intersecting a second plurality of parallel conductive lines to provide a plurality of square regions bounded on sides by the conductive lines. The single conductive screen includes an array of double-loop conductive elements each provided as an inner conductive loop disposed within an outer conductive loop within each of the square regions. The square grid rejects low frequency signals, while the size of the inner and outer conductive loops determine two separate frequency rejection bands.

According to a second embodiment, the frequency selective surface filter includes two conductive screen layers separated by a dielectric medium. The first conductive layer has an array of double loop slots. Each of the double loop slots includes an inner slot surrounded by an outer slot. The first conductive layer allows the transmission of signals within a first frequency band to pass through the first conductive layer, while rejecting signals within a second frequency band. The frequency rejection band is determined as a function of size of the slots. The second conductive layer includes an array of single conductive loops which effectively pass signals in the first frequency band, while rejecting signals in a third frequency band. The two screen embodiment achieved wide bandwidth frequency filtering of signals with frequencies within the rejection bands.

The one screen and two screen embodiments of the frequency selective surface filter are compact and lightweight and are particularly useful in connection with a transmit antenna such as a multibeam phased array transmit antenna. According to one application, the frequency selective surface filter is disposed in communication with the multibeam phased array transmit antenna to allow for the transmission of signals within a first designated frequency band. The frequency selective surface filter filters out signals within the rejection bands, especially those signals having frequencies associated with second and third harmonics caused by non-linear elements in the transmit antenna.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
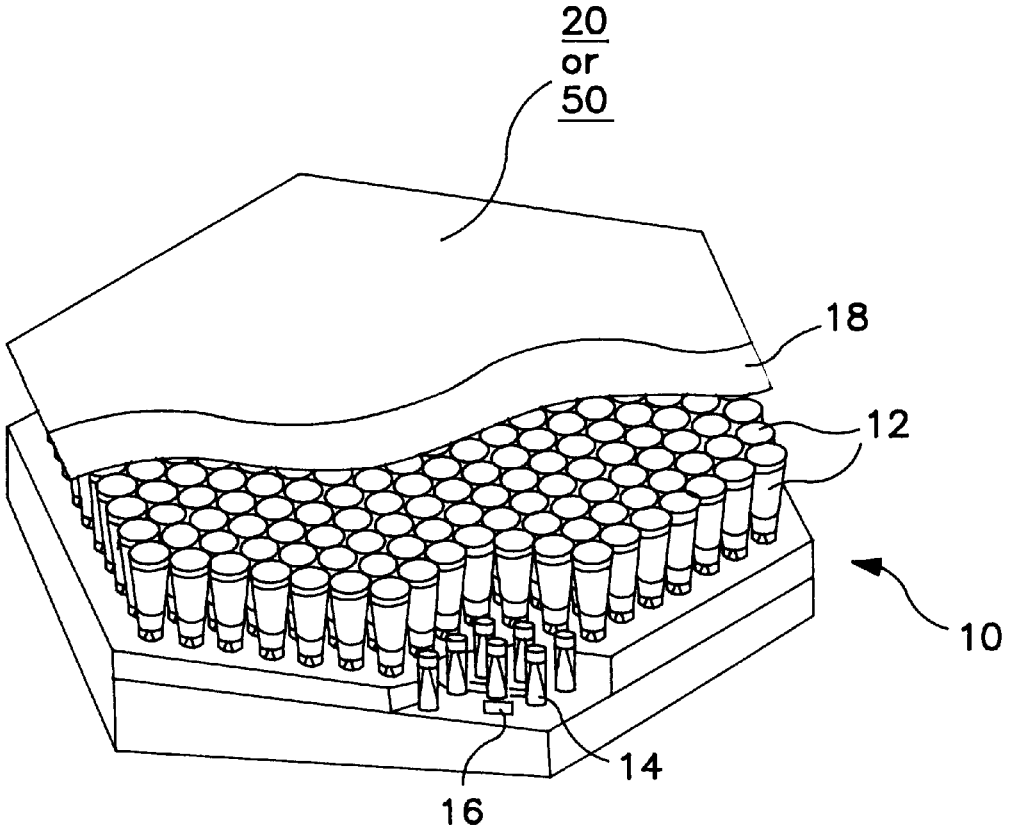
FIG. 1 is a partial cut-out view of a multibeam phased array transmit antenna having a frequency selective surface filter disposed on the top surface thereof.

Turning now to FIG. 1, a multibeam phased array transmit antenna 10 is provided with a frequency selective surface filter 20 or 50 in accordance with the present invention. The multibeam phased array antenna 10 is particularly suited for use in connection with a satellite communication system which may include both transmit and receive antennas for communicating with ground based communication systems. As one example, the transmit antenna may be operable for transmitting signals having frequencies of approximately 20.2 to 21.2 GHz within the K-band, while the receive antenna may be operable to receive signals having frequencies of approximately 40.4 to 45.5 GHz within the Q-band. In addition, a satellite communication system may include antennas for transmitting and receiving cross link communication signals among various satellites at frequencies of approximately 60.6 to 63.6 GHz within the V-band. The phased array antenna 10 as shown and explained in connection with the present invention is a transmit antenna. However, it should be appreciated that the frequency selective surface filter employed in connection with the antenna 10 may be applicable for use in connection with various commercial and military antenna and radome systems for both receive and transmit antennas, and the frequency bands of operation may be scaled to other frequency bands, without departing from the principles of the present invention.

The multibeam phased array antenna 10 as shown includes an array of metalized plastic feed horns 12 configured side-by-side in a planar arrangement. However, antenna 10 may include a single radiating element or multiple radiating elements configured in various other configurations including a curved configuration. The antenna 10 described herein is a transmit antenna for transmitting transmit signals at frequencies of 20.2 to 21.2 GHz within the K-band. The antenna 10 includes a circular-to-rectangular transition element 14 and a beam forming network with amplifiers 16. In addition, the multibeam phased array antenna 12 has a linear-to-circular polarizer 18 disposed at the output of the feed horns 12. The frequency selective surface filter 20 or 50 as explained herein rejects signals which may be produced as high frequency second and third harmonics due to the non-linear characteristics of the amplifiers 16. The frequency selective surface filter 20 or 50 of the present invention rejects signals with certain frequencies so it will not interfere with other antenna operations.

Figure 2:
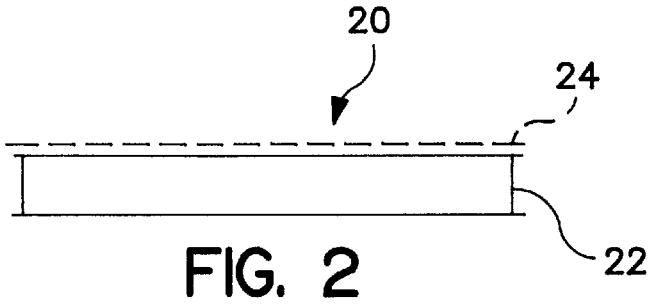
FIG. 2 is a cross-sectional view of a single-screen frequency selective surface filter according to one embodiment of the present invention.

Referring to FIG. 2, the frequency selective surface filter 20 is shown in a cross-sectional view containing a single conductive screen according to one embodiment of the present invention. The single conductive screen embodiment is hereafter referred to as the single-screen frequency selective surface filter 20. The single-screen frequency selective surface filter 20 contains a single conductive circuit layer 24 made up of a conductor printed or otherwise fabricated on top of a thin planar dielectric layer 22. The conductive pattern provided on the single conductive circuit layer 24 may be printed or etched on the dielectric layer 22 in accordance with well known printed circuit manufacturing techniques. The thin dielectric layer 22 may include a dielectric substrate such as a known thin space qualified material such as polymide or other suitable material. One known dielectric is identified as Kapton which is manufactured by E. I. duPont de Nemours and Company, Inc.

Figure 3:
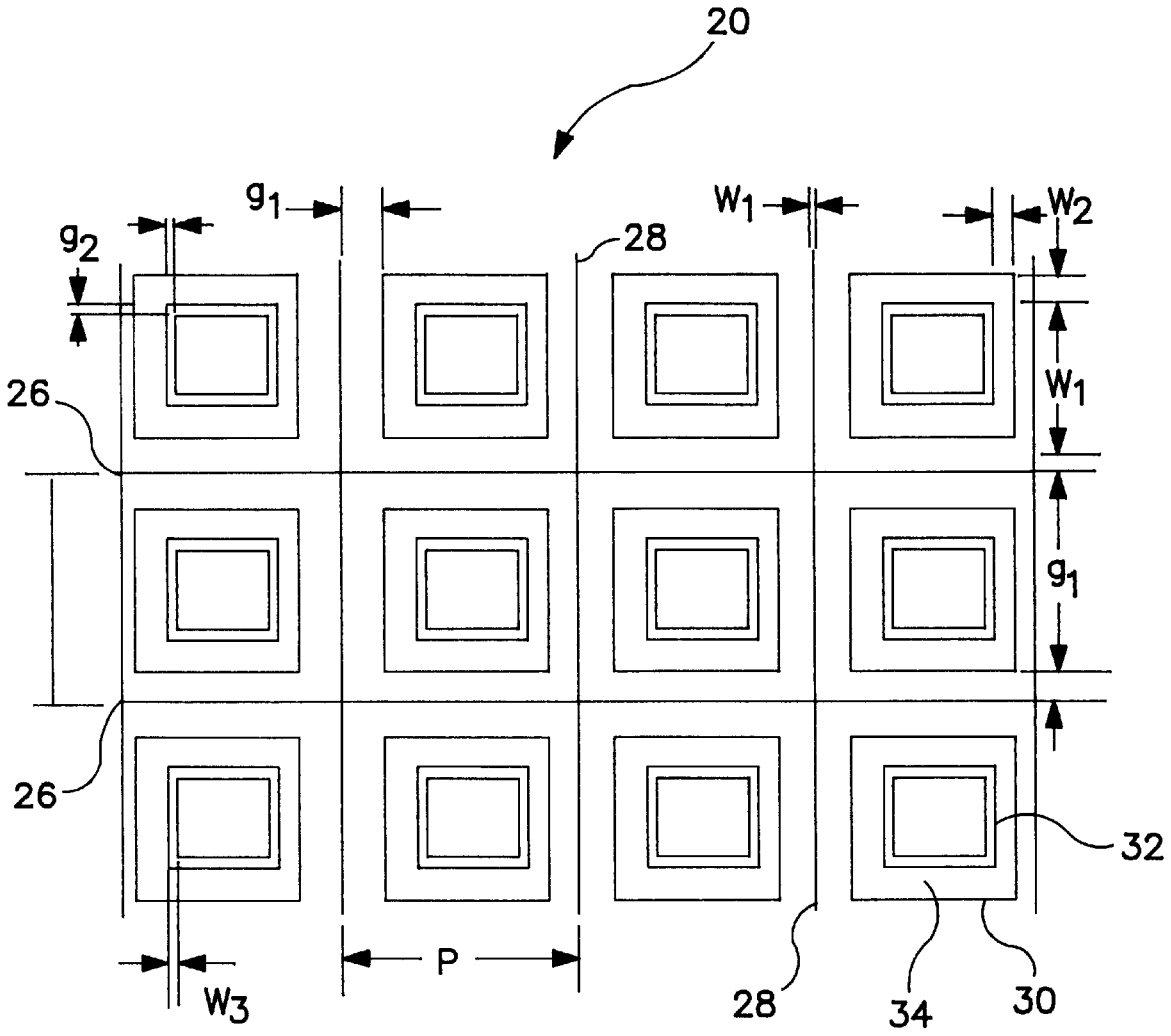
FIG. 3 is a top view of a portion of the single-screen frequency selective surface filter of FIG. 2.

The single conductive screen 24 is made up of a conductive material such as copper or other suitable material and is configured as shown in FIG. 3. The frequency selective surface filter 20 includes a gridded square array made up of a first plurality of parallel conductive lines 26 perpendicularly intersecting a second plurality of parallel conductive lines 28. The gridded square array therefore provides for a plurality of square regions separated by the perpendicularly intersecting parallel conductive lines 26 and 28. The width of the conductive lines 26 and 28 is represented by $W_1$. The distance between adjacent parallel conductive lines 26 and also between adjacent parallel conductive lines 28 is represented by P. The distance P represents the periodic interval of the square regions provided by conductive lines 26 and 28. In effect, the gridded square array made up of conductive lines 26 and 28 provides a low frequency rejection band which advantageously filters out low frequency signals.

The multibeam phased array antenna 10 further includes an array of double-loop conductive elements provided in the square regions. Each of the double-loop conductive elements is made up of an inner-conductive loop 32 configured within an outer conductive loop 30. The inner conductive square loop 32 has a width identified as $W_3$, while the outer conductive square loop 30 has a width identified as $W_2$. The frequency rejection bandwidth may be realized as a function of the widths $W_2$ and $W_3$. Accordingly, widths $W_2$ and $W_3$ are related with a widened size to provide a widened band of rejection. The inner and outer conductive square loops 30 and 32 are separated by a non-conductive isolation loop 34 which has a width identified as $g_2$. Accordingly, the outer conductive square loop 30 is dielectrically separated from the inner conductive square loop 32 by a distance $g_2$. In addition, outer conductive square loop 30 is separated from the conductive grid lines 26 and 28 via a non-conductive region by a distance $g_1$.

The array of double-loop conductive elements made up of conductive loops 30 and 32 provides for a first frequency rejection band and a second frequency rejection band. The inner conductive square loop 32 is configured with an outer conductive circumference of a distance equal to or close to the wavelength of signals to be rejected by inner conductive square loop 32. Similarly, the outer conductive square loop 30 has an outer conductive circumference configured of a distance approximately equal to or close to the wavelength of signals that are to be rejected with the outer conductive loop 30. The distance of the circumference of each of the conductive loops 30 and 32 is equal to the wavelength of a frequency substantially centered in first and second rejection bands. Depending on the widths $W_2$ and $W_3$ of the conductive loops 30 and 32, respectively and the attenuation acceptance, the first and second rejection band extend over a range of frequencies in a rejection bandwidth.

According to one example, the single-screen frequency selective surface filter 20 may include the following geometric pattern dimensions:

| |
|---|
| P = 0.1378 Inches |
| $W_1$ = 0.0043 Inches |
| $W_3$ = 0.0043 Inches |
| $g_2$ = 0.0043 Inches |
| $W_2$ = 0.0172 Inches |
| $g_1$ = 0.0172 Inches |

Figure 4:
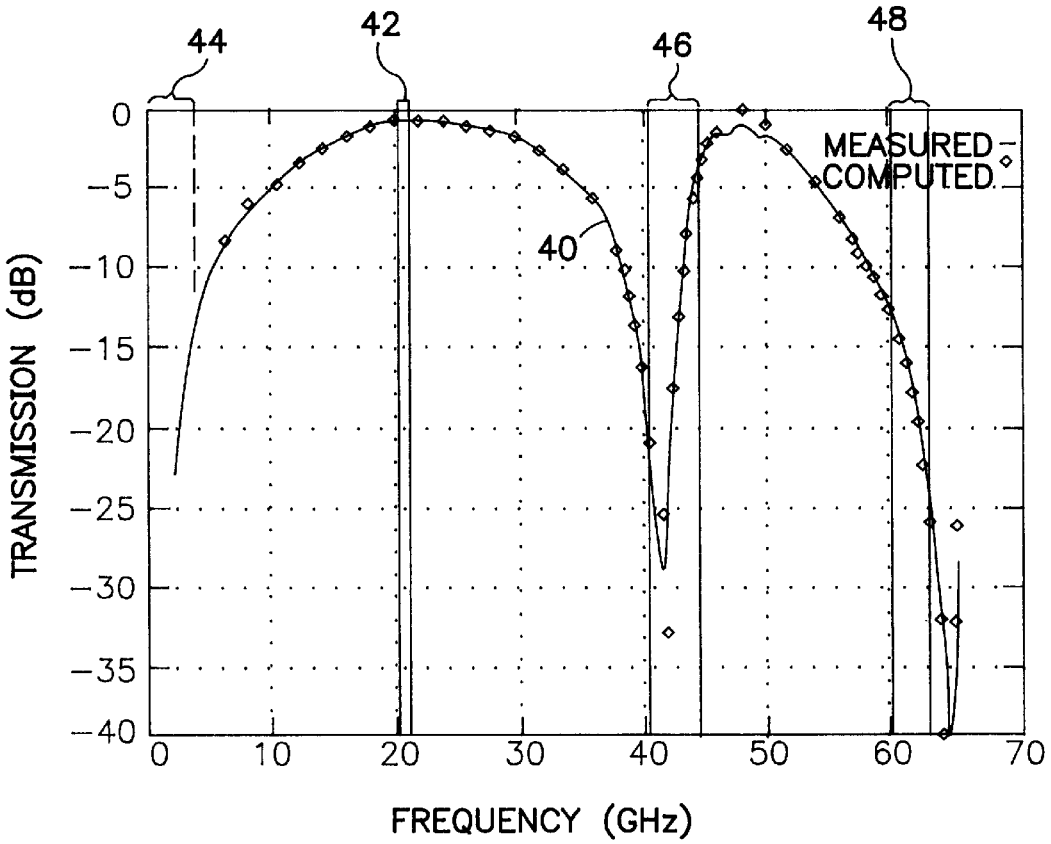
FIG. 4 illustrates one example of the signal transmission response that may be realized with the single-screen embodiment of the frequency selective surface filter.
Figure 7:
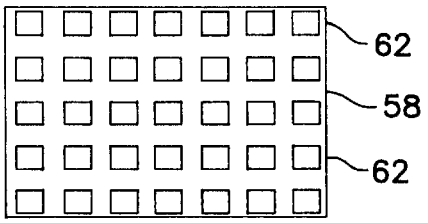
FIG. 7 is a top view of a portion of the top layer of the double-screen frequency selective surface filter of FIG. 5.

As evidenced by the above example, the single-screen frequency selective surface filter 20 can be configured with small dimensions and may consume a small volume. The above example provides generic geometric dimensions suitable for achieving a signal transmission response 40 such as that provided in FIG. 4 which shows signal transmission in decibels (dB) versus frequency achievable with the single-screen frequency selective surface filter 20. The single-screen frequency selective surface filter 20 essentially provides three rejection bands 44, 46 and 48, while allowing signal transmission in a desired frequency band as evidenced by the passband 42.

In effect, the intersecting parallel conductive lines 26 and 28 provide a low-frequency rejection band 44 which filters out low frequency signals, including low frequency noise induced signals. For an attenuation drop of fifteen decibels (15 dB), the low-frequency rejection bandwidth extends from frequencies of about zero to three GHz. The outer conductive square loop 30 provides frequency rejection band 46 to reject those signals of approximately 40.4 to 45.5 GHz. The inner conductive square loop 32 provides frequency rejection band 48 to reject signals having frequencies of approximately 60.6 to 63.6 GHz. The bandwidth of each of rejection bands 44, 46 and 48 may vary depending on the preferred attenuation. Accordingly, rejection bands 44, 46 and 48 effectively filter out noise induced signals as well as high frequency second and third harmonics which may be present due to the non-linear effects, especially those associated with the amplifier circuitry. Accordingly, the multibeam phased array transmit antenna 10 may operate effectively within the designated pass band 42, while reducing or eliminating problems associated with unwanted high frequency harmonics.

Figure 5:
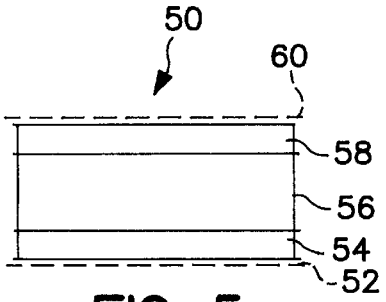
FIG. 5 is a cross-sectional view of a double-screen frequency selective surface filter having two conductive layers according to a second embodiment of the present invention.

According to a second embodiment, the frequency selective surface filter 50 includes two conductive screen layers for providing wide band frequency filtering. The double conductive screen embodiment is hereafter referred to as the double-screen frequency selective surface filter. Referring to FIG. 5, the double-screen frequency selective surface filter 50, shown in a cross-sectional view, includes a dielectric medium 58 with a first conductive screen 60 printed or otherwise fabricated on the top surface of a thin dielectric medium 58. Similarly, frequency selective surface filter 50 includes a second thin dielectric medium 54 with a second conductive screen 52 printed or otherwise fabricated on the bottom surface of the second thin dielectric medium 54. In addition, frequency selective surface filter 50 further includes a thicker dielectric separating medium 56 disposed between the first and second dielectric mediums 58 and 54 to provide isolation between the first and second conductive screens 60 and 52. The thin dielectric materials 58 and 54 may include a dielectric material of the type identified for dielectric layer 22, while dielectric isolation layer 56 may include foam or other suitable dielectric medium which is similarly transparent to electromagnetic radiation. According to one example, the thin dielectric layers 58 and 54 may each include a thickness of one mil, while the thicker dielectric isolation layer 56 may include a thickness of 189 mil.

Figure 6:
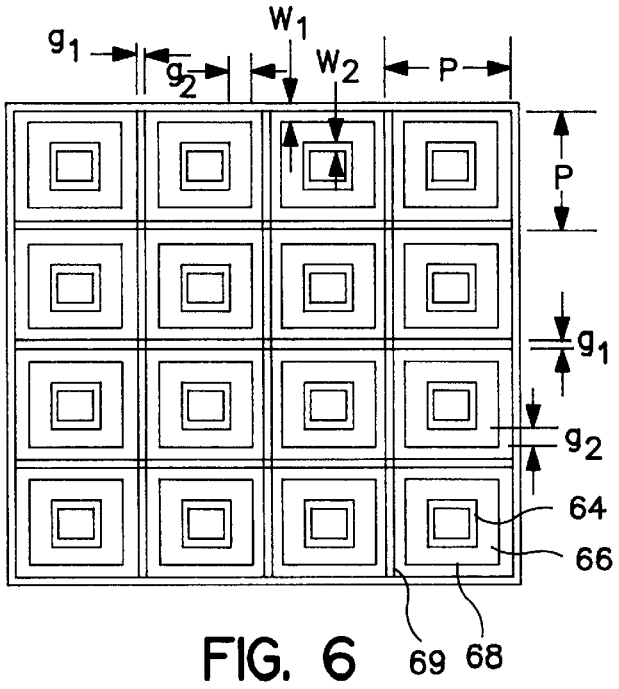
FIG. 6 is a bottom view of a portion of the bottom layer of the double-screen frequency selective surface filter of FIG. 5.

Referring to FIG. 6, the bottom conductive screen 52 is shown to include an array of double-square slots each of which includes an inner non-conductive slot 64 and an outer non-conductive slot 66 both edged in conductive screen layer 52. The inner and outer slots 64 and 66 are separated via a conductive region 68. Further, the outer slots 66 are separated from adjacent outer slots by conductive lines 69. Conductive lines 69 have a width identified as $g_1$. The conductive region 68 separating slots 64 and 66 has a square configuration with a width identified as $g_2$. The outer slot 66 has a width identified as $W_1$, while the inner slot 64 has a width identified as $W_2$. The conductive lines 69 are separated by a distance P which defines the periodic interval of the array of double-square slots.

The bottom conductive screen 52 provides first and second frequency passbands as a function of the dimensions of the inner and outer slots 64 and 66. The inner slot 64 has a circumference of a distance equal to one wavelength of the frequency defining the first passband. The outer slot 66 similarly has a circumference of a distance equal to one wavelength of the frequency defining the second passband. The first and second passbands extend over a band of frequencies. Accordingly, signals within the first and second passbands are able to resonate through the bottom conductive screen 52, while other frequency signals are rejected.

The top conductive screen 60 is configured with an array of single-square conductive loops 62 printed or otherwise fabricated on the top surface of dielectric medium 58. Each of the conductive square loops 62 has a circumference of a distance equal to one wavelength of the frequency that defines the rejection band. The rejection band provided by conductive loops 62 effectively extends over a range of frequencies. Accordingly, the single-square loop configuration rejects signals within the rejection band as a function of the dimensions of the single-square loop. The rejection band provided by the top conductive screen 60 may be selected equal to one of the first or second passbands provided by the bottom conductive screen 52 so as to achieve multiple rejection bands and allow transmission of signals within one frequency passband. According to one example, the bottom conductive screen 52 may be configured with the following dimensions:

| |
|---|
| P = 0.1496 Inches |
| $W_1$ = 0.00935 Inches |
| $g_1$ = 0.00935 Inches |
| $W_2$ = 0.00935 Inches |
| $g_2$ = 0.02805 Inches |

In connection with the above-identified example, the top conductive screen 60 may be configured with the following dimensions:

| |
|---|
| P = 0.0996 Inches |
| W = 0.0062 Inches |
| g = 0.03735 Inches |

Figure 8:
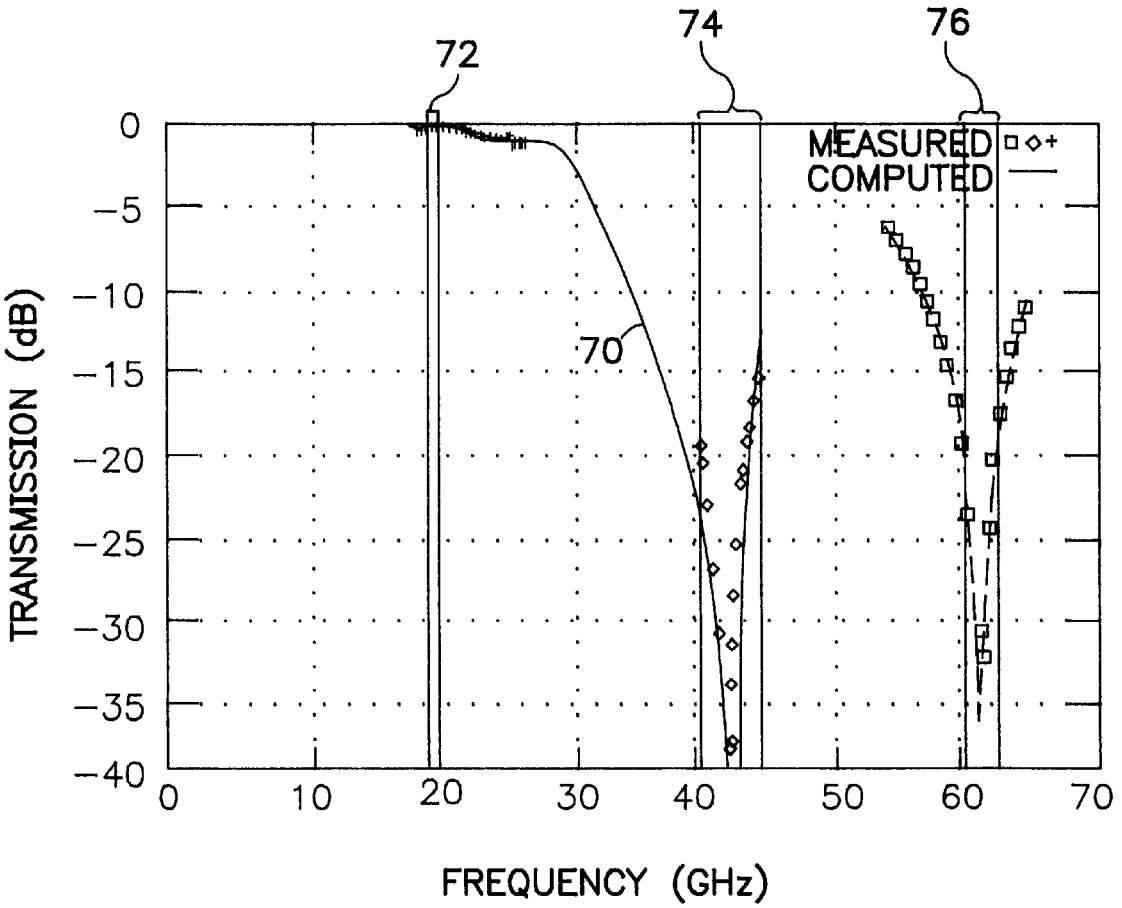
FIG. 8 illustrates one example of the signal transmission response that may be realized for the frequency selective surface filter according to the double screen embodiment.

According to the above-identified example of filter 50, the double-screen configuration of the frequency selective surface filter 50 may provide operational characteristics as shown by the transmission response 70 in the graph of FIG. 8. The frequency selective surface filter 50 provides a frequency passband identified as 72 which defines the frequency range over which signals are allowed to radiate through frequency selective surface filter 50. The frequency selective surface filter 50 also effectively provides wide frequency rejection bands 74 and 76. In effect, the inner slot 64 of bottom conductive screen 52 allows signals with frequencies of approximately 20.2 to 21.2 GHz to radiate through bottom conductive screen 52. screen 52 allows signals with frequencies of approximately 60.6 to 63.6 GHz to Similarly, the conductive loops 62 of the top conductive screen 60 allow signals with frequencies of approximately 20.2 to 21.2 GHz to radiate through the top conductive screen 60. The bottom conductive screen 52 effectively rejects signals with frequencies in the rejection band 74. The top conductive screen 60 effectively rejects signals having frequencies of 60.6 to 63.6 GHz. The bottom conductive screen 52 does not provide some attenuation of the V-band frequencies and the top conductive screen 60 does provide some attenuation of the Q-band frequencies. Therefore, the combination of the top and bottom conductive screens 60 and 52 effectively reject the signals within the widened rejection band 74 and signals within the rejection band 76, while at the same time providing little or no attenuation of the frequencies in the passband 72.

The frequency selective surface filter 20 or 50 of the present invention offers multiple frequency rejection bands in a thin, lightweight and low cost package. The single-screen frequency selective surface filter 20 provides good performance with low frequency filtering in a very thin package, while the double-screen frequency selective surface filter 50 is able to achieve widened frequency rejection to improve filtering at desired frequency bandwidths. In addition, the frequency selective surface filter 20 or 50 includes equal rectilinear (x and y) line dimensions suitable for use for both vertical and horizontal polarizations, and also suitable for circular polarization. Accordingly, the frequency selective surface filter 20 or 50 is small and lightweight and advantageously suitable for use in connection with a transmit antenna.

In view of the foregoing, it can be appreciated that the present invention enables the user to achieve a compact frequency selective surface filter suitable for use in connection with a transmit antenna. Thus, while this invention has been disclosed herein in combination with a particular example thereof, no limitation is intended thereby except as defined in the following claims.

We claim:

1. A frequency selective surface filter for providing multiple frequency rejection bands, said frequency selective surface filter comprising:

a dielectric substrate that is substantially transparent to electromagnetic signal transmission;

a square grid disposed on said dielectric substrate including a first plurality of conductors extending in a first direction and intersecting a second plurality of conductors extending in a second direction which is substantially perpendicular to the first direction, said square grid providing a first frequency rejection band; and a plurality of double-loop conductive elements, each of said double-loop conductive elements including an inner loop and an outer loop located in each region of the square grid, said outer loop encircling the inner loop, and said first loop providing a second frequency rejection band and said second loop providing a third frequency rejection band.

2. The frequency selective surface filter as defined in claim 1 wherein said dielectric substrate is provided as a thin substantially planar medium.

3. The frequency selective surface filter as defined in claim 1 wherein said inner and outer loops are each configured as square loops.

4. The frequency selective surface filter as defined in claim 1 wherein said frequency selective surface filter is disposed in communication with a multibeam phased array antenna.

5. The frequency selective surface filter as defined in claim 1 wherein said frequency selective surface filter is disposed in communication with a transmit antenna, said frequency selective surface filter filtering out higher frequency harmonics produced by non-linear characteristics of circuitry components in the transmit antenna.

6. A frequency selective surface filter comprising:

a dielectric medium that is substantially transparent to electromagnetic signal transmission and having a top surface and a bottom surface;

an array of double-loop slots provided in a first conductor material on one of the top and bottom surfaces of said dielectric medium, each of said double loop slots including an inner radiating slot encircled by an outer radiating slot for passing signals in a first frequency band and a second frequency band while rejecting signals in a first rejection band; and an array of conductive loop elements disposed on the other of said top and bottom surfaces of the dielectric layer, for rejecting signals in a second rejection band.

7. The frequency selective surface filter as defined in claim 6 wherein said frequency selective surface filter is disposed in communication with a multibeam phased array antenna.

8. The frequency selective surface filter as defined in claim 6 wherein said frequency selective surface filter is disposed in communication with a transmit antenna, said frequency selective surface filter filtering out higher frequency harmonics produced by non-linear characteristics of circuitry components in the transmit antenna.

9. The frequency selective surface filter as defined in claim 6 wherein said dielectric medium has substantially planar top and bottom surfaces.

10. The frequency selective surface as defined in claim 6 wherein each of said conductive loop elements comprises a single conductive loop.

11. The frequency selective surface as defined in claim 6 wherein said conductive loop elements are configured as square loops.

12. The frequency selective surface as defined in claim 6 wherein said slots each are configured as square loop slots.

13. The frequency selective surface as defined in claim 6 wherein said dielectric medium comprises:

a first thin dielectric substrate providing the top surface; and a second thin dielectric substrate providing the bottom surface.

14. The frequency selective surface as defined in claim 13 wherein said dielectric medium further comprises a dielectric isolation layer disposed between the first and second thin dielectric substrates.

15. An antenna comprising:

one or more radiating elements for radiating electromagnetic radiation;

transmit circuitry for generating signals for transmission from said one or more radiating elements; and a frequency selective surface disposed in communication with the one or more radiating elements so as to provide selective frequency filtering, said frequency selective surface filter including a thin dielectric medium that is transparent to electromagnetic signal transmission said frequency surface further including frequency dependent elements for providing multiple frequency rejection bands to reject unwanted signals within the multiple frequency bands.

16. The antenna as defined in claim 15 wherein said frequency selective surface further comprises:

a square grid including a first plurality of conductors extending in a first direction and intersecting a second plurality of conductors extending in a second direction which is substantially perpendicular to the first direction, said square grid providing a first frequency rejection band; and a plurality of double-loop conductive elements, each of said double-loop conductive elements including an inner loop and an outer loop located in each region of the square grid, said outer loop encircling the inner loop, and said first loop providing a second frequency rejection band and said second loop providing a third frequency rejection band.

17. The antenna as defined in claim 15 wherein said frequency selective surface further comprises:

an array of double-loop slots provided in a first conductor material on one of the top and bottom surfaces of said dielectric medium, each of said double loop slots including an inner radiating slot encircled by an outer radiating slot for passing signals in a first frequency band and a second frequency band while rejecting signals in a first rejection band; and an array of conductive loop elements disposed on the other of said top and bottom surfaces of the dielectric layer, for rejecting signals in a second rejection band.

18. The antenna as defined in claim 15 wherein said one or more radiating elements comprises a multibeam phased array.

* * * * *